US009142168B2

(12) United States Patent
Hsu et al.

(10) Patent No.: US 9,142,168 B2
(45) Date of Patent: Sep. 22, 2015

(54) METHOD AND APPARATUS FOR DRIVING A DISPLAY DEVICE

(75) Inventors: Xie-Ren Hsu, Hsinchu (TW); Wei-Song Huang, Hsinchu (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 140 days.

(21) Appl. No.: 13/170,162

(22) Filed: Jun. 27, 2011

(65) Prior Publication Data

US 2012/0223975 A1 Sep. 6, 2012

(30) Foreign Application Priority Data

Mar. 3, 2011 (TW) ..... 100107102 A

(51) Int. Cl.
*G09G 5/10* (2006.01)
*G09G 3/36* (2006.01)

(52) U.S. Cl.
CPC ..... *G09G 3/36* (2013.01); *G09G 2290/00* (2013.01); *G09G 2320/0276* (2013.01); *G09G 2320/0673* (2013.01)

(58) Field of Classification Search
CPC ..... G09G 2320/0673; G09G 2320/0276; G09G 3/3696; G09G 2320/0247; G09G 2320/0242; G09G 2330/021; G09G 3/3607; G02F 2001/134345; H04N 13/0029
USPC ..... 345/87–104, 204–215
See application file for complete search history.

(56) References Cited

U.S. PATENT DOCUMENTS

| | | | | |
|---|---|---|---|---|
| 2005/0140627 | A1* | 6/2005 | Moon | 345/89 |
| 2006/0214895 | A1* | 9/2006 | Shih et al. | 345/88 |
| 2007/0285369 | A1* | 12/2007 | Park et al. | 345/90 |
| 2008/0143754 | A1* | 6/2008 | Lee | 345/690 |
| 2008/0174534 | A1* | 7/2008 | Park | 345/87 |
| 2008/0198151 | A1* | 8/2008 | Lee et al. | 345/207 |
| 2008/0266331 | A1* | 10/2008 | Chen et al. | 345/690 |
| 2011/0057958 | A1* | 3/2011 | Morita | 345/690 |
| 2012/0098830 | A1* | 4/2012 | Kim | 345/419 |

FOREIGN PATENT DOCUMENTS

| | | | |
|---|---|---|---|
| CN | 1637837 | A | 7/2005 |
| CN | 101295472 | A | 10/2008 |
| CN | 101206841 | B | 9/2010 |
| TW | I307873 | | 3/2009 |
| TW | 201003630 | | 1/2010 |
| WO | 2010150973 | A1 | 12/2010 |

* cited by examiner

*Primary Examiner* — Abbas Abdulselam
*Assistant Examiner* — Gerald Oliver
(74) *Attorney, Agent, or Firm* — Winston Hsu; Scott Margo

(57) ABSTRACT

The present invention discloses a driving device of a display device. The driving device comprises a gamma voltage generator, for generating a gamma voltage according to a control signal to a source driver of the display device, and a logic unit, for generating the control signal to the gamma voltage generator according to a difference among image properties of a plurality of frames to be displayed, to adjust the gamma voltage.

13 Claims, 4 Drawing Sheets

METHOD AND APPARATUS FOR DRIVING A DISPLAY DEVICE

BACKGROUND OF THE INVENTION

1. Field of the Invention

The present invention relates to a method and apparatus for driving a display device, and more particularly, to a method and apparatus for driving a display device capable of adjusting a gamma voltage according to a difference among image properties of frames to be displayed, to reduce power consumption of the display device.

2. Description of the Prior Art

Comparing with a cathode ray tube (CRT) display device, a liquid crystal display (LCD) device is provided with advantages of lighter weight, less power consumption and less radiation contamination, and has been widely applied to various information technology (IT) products, such as computer systems, mobile phones, notebooks, digital cameras and personal digital assistants (PDAs). An operating principle of the LCD device is based on a fact that different twisted states of liquid crystals result in different polarizations and refractions on light passing through the liquid crystals. Thus, the different twisted states of the liquid crystals can be used to control an amount of the light emitted from the LCD device, so as to produce light outputs at various brightnesses, and diverse gray levels of red, green and blue light.

With growing environmental consciousness, industries have devoted efforts to develop products with low power consumption, where most products produced by IT industries are electronic devices consuming electricity. Taking the LCD device as an example, even though a standby LCD device consumes only a few watts of electric power, an operating LCD device may consume tens to hundreds of watts of electric power according to a size of the operating LCD device. A user of the LCD device does not need to watch frames with a high contrast ratio in many daily situations, such as browsing the web, doing word processing, and sending and receiving emails. How to conserve electric power in the many situations is a topic for discussion.

SUMMARY OF THE INVENTION

It is therefore an objective of the present invention to provide a method and apparatus for driving a display device, to reduce power consumption of the display device.

The present invention discloses a driving device of a display device. The driving device comprises a gamma voltage generator, for generating a gamma voltage according to a control signal to a source driver of the display device, and a logic unit, for generating the control signal to the gamma voltage generator according to a difference among image properties of a plurality of frames to be displayed, to adjust the gamma voltage.

The present invention discloses a driving method of a display device. The driving method comprises generating a gamma voltage according to a control signal to a source driver of the display device, and generating the control signal according to a difference among image properties of a plurality of frames to be displayed, to adjust the gamma voltage.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
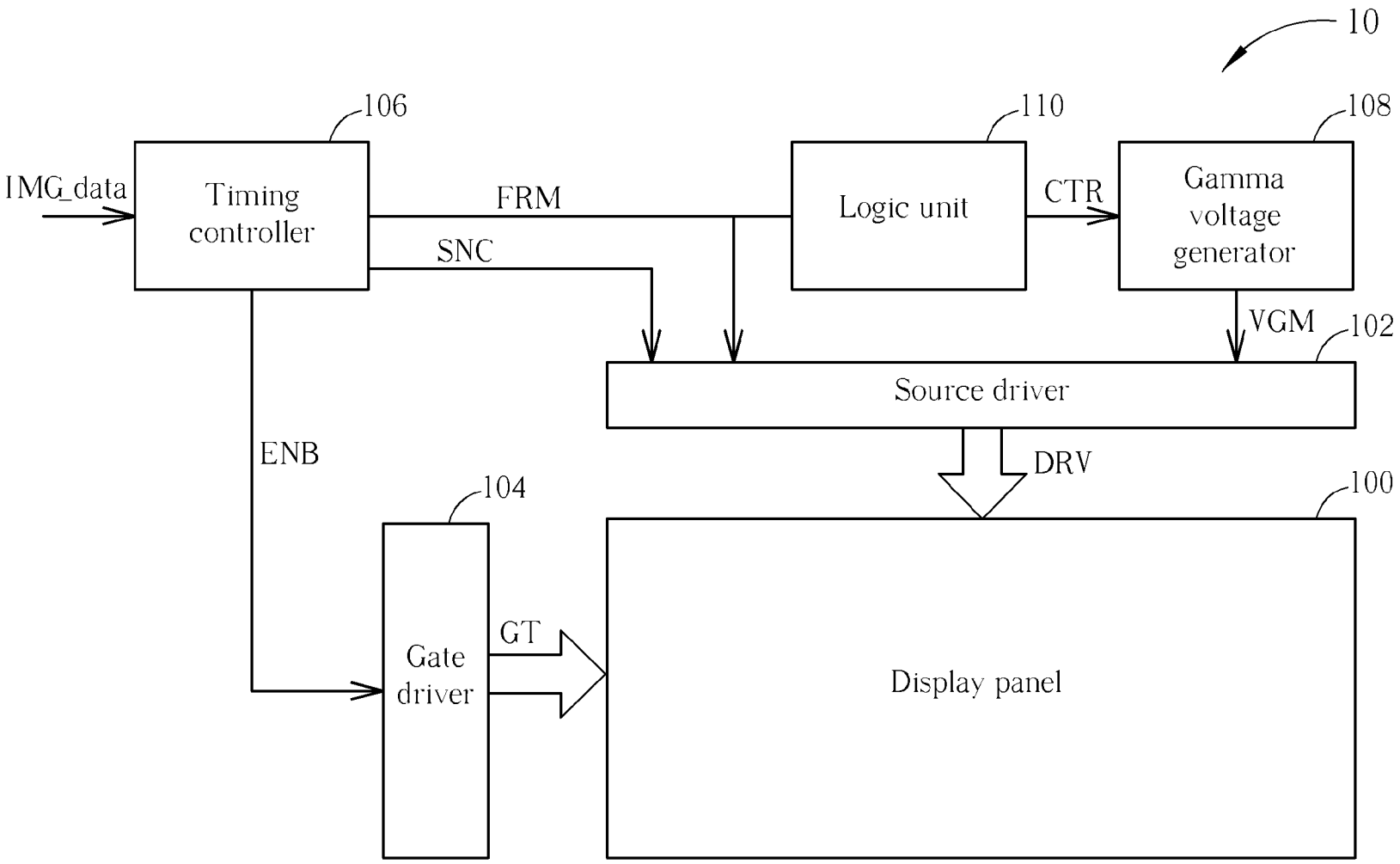
FIG. 1 is a schematic diagram of a liquid crystal display device according to an embodiment of the present invention.

Pleas refer to FIG. 1, which is a schematic diagram of a liquid crystal display (LCD) device 10 according to an example of the present invention. The LCD device 10 includes a display panel 100, a source driver 102, agate driver 104, a timing controller 106, a gamma voltage generator 108 and a logic unit 110. The gamma voltage generator 108 and the logic unit 110 operate to reduce power consumption of the LCD device 10, and can be combined as a driving device or be integrated into the timing controller 106, but are not limited herein.

An operating principle of the LCD device 10 is detailed as follows. First, the timing controller 106 generates an enable signal ENB, a clock signal SNC and a frame signal FRM. Then, the gate driver 104 generates a gate signal GT corresponding to the enable signal ENB to the display panel 100, to control conducting states of thin film transistors. The source driver 102 generates a driving signal DRV to the display panel 100 according to the clock signal SNC, the frame signal FRM and a gamma voltage VGM generated by the gamma voltage generator 108, to sequentially control gray levels of pixels of the display panel 100. Finally, the display panel 100 drives twisted states of liquid crystals according to the gate signal GT and the driving signal DRV, to display corresponding frames.

The logic unit 110 receives the frame signal FRM, and generates a control signal CTR according to a difference among image properties of frames to be displayed in the frame signal FRM, such as contrast ratios. The gamma voltage generator 108 generates the gamma voltage VGM to the source driver 102 of the LCD device 10 according to the control signal CTR. In other words, the gamma voltage VGM generated by the gamma voltage generator 108 is controlled by the logic unit 110. More specifically, the gamma voltage VGM relates to the image properties of the frames to be displayed.

Please note that, in the LCD device 10, the gamma voltage VGM generated by the gamma voltage generator 108 is controlled by the logic unit 110, or the gamma voltage VGM relates to the image properties of the frames to be displayed, and corresponding modifications and alterations are within the scope of the present invention. For example, to realize the above mentioned functions, the gamma voltage generator 108 needs to generate a plurality of voltages, and outputs a voltage of the plurality of voltages as the gamma voltage VGM according to the control signal CTR. Please refer to FIG. 2, which is a schematic diagram of a voltage divider circuit 200 according to an example of the present invention. The voltage divider circuit 200 is used to realize the gamma voltage generator 108 of FIG. 1, to provide one of gamma voltages VGM_a_1-VGM_a_n as the gamma voltage VGM. The gamma voltages VGM_a_1-VGM_a_n can be reduced or retained by the voltage divider circuit 200 according to the control signal CTR. The voltage divider circuit 200 includes a reference voltage generator 202, a switch 204 and resistors R1-RN. The reference voltage generator 202 generates a reference voltage VRF, and the switch 204 controls a connection between the reference voltage generator 202 and the resistors R1-RN, to reduce or retain the gamma voltages VGM_a_1-

VGM_a_n. For example, when a difference among contrast ratios of the frames to be displayed is larger than a predefined value, the logic unit 110 determines that contrast ratios of frames watched by a user do not need to be changed. Then, the logic unit 110 controls the switch 204 by using the control signal CTR, to retain the gamma voltages VGM_a_1-VGM_a_n. Oppositely, when the difference among the contrast ratios of the frames to be displayed is lower than the predefined value, the logic unit 110 determines that the contrast ratios of the frames watched by the user need to be reduced. Then, the logic unit 110 controls the switch 204 by using the control signal CTR, to connect the resistors R1-RN and resistor 304, so as to reduce the gamma voltages VGM_a_1-VGM_a_n. As a result, the power consumption of the LCD device 10 is reduced.

Figure 3:
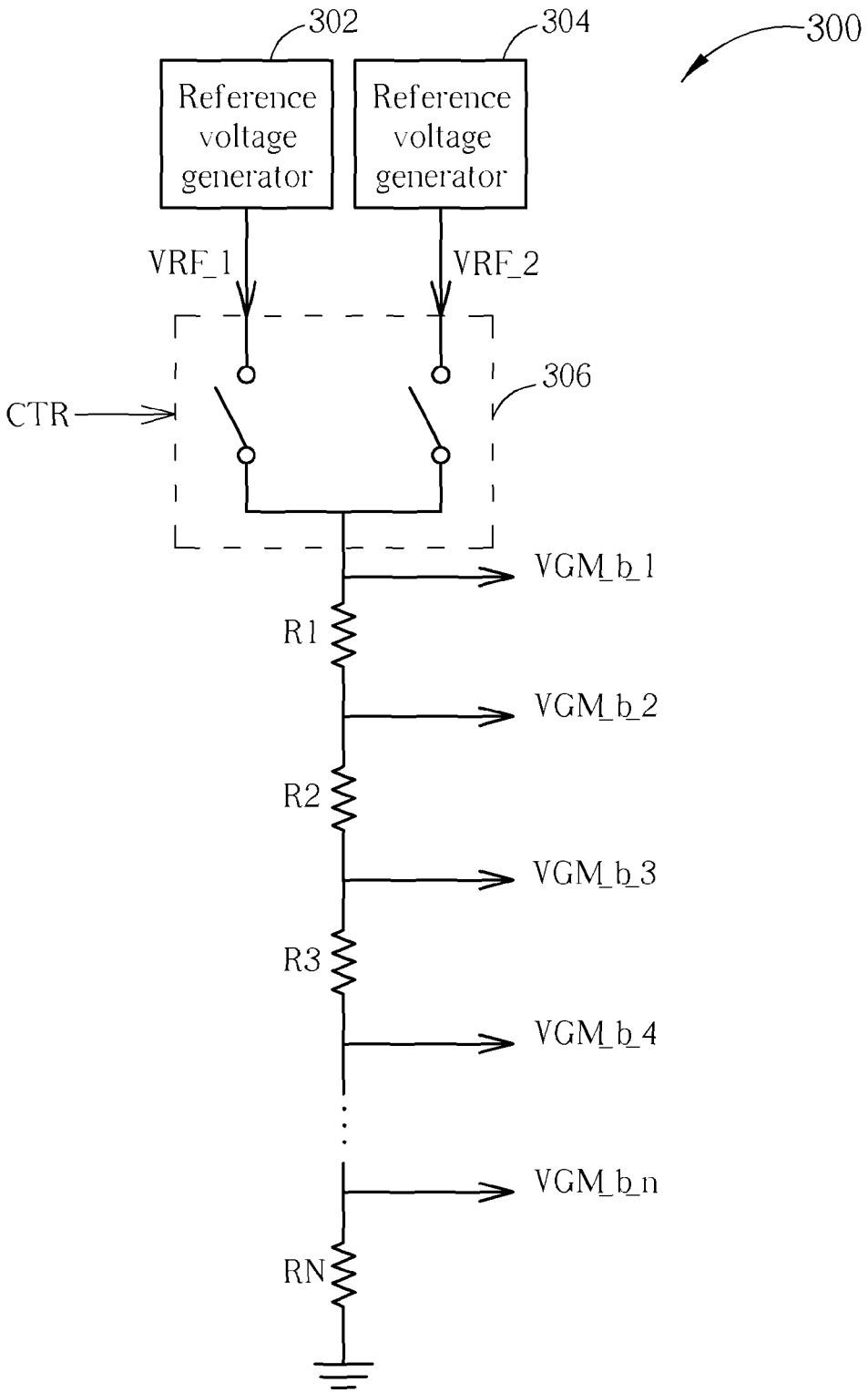
FIG. 3 is a schematic diagram of a voltage divider circuit according to an embodiment of the present invention.
Figure 4:
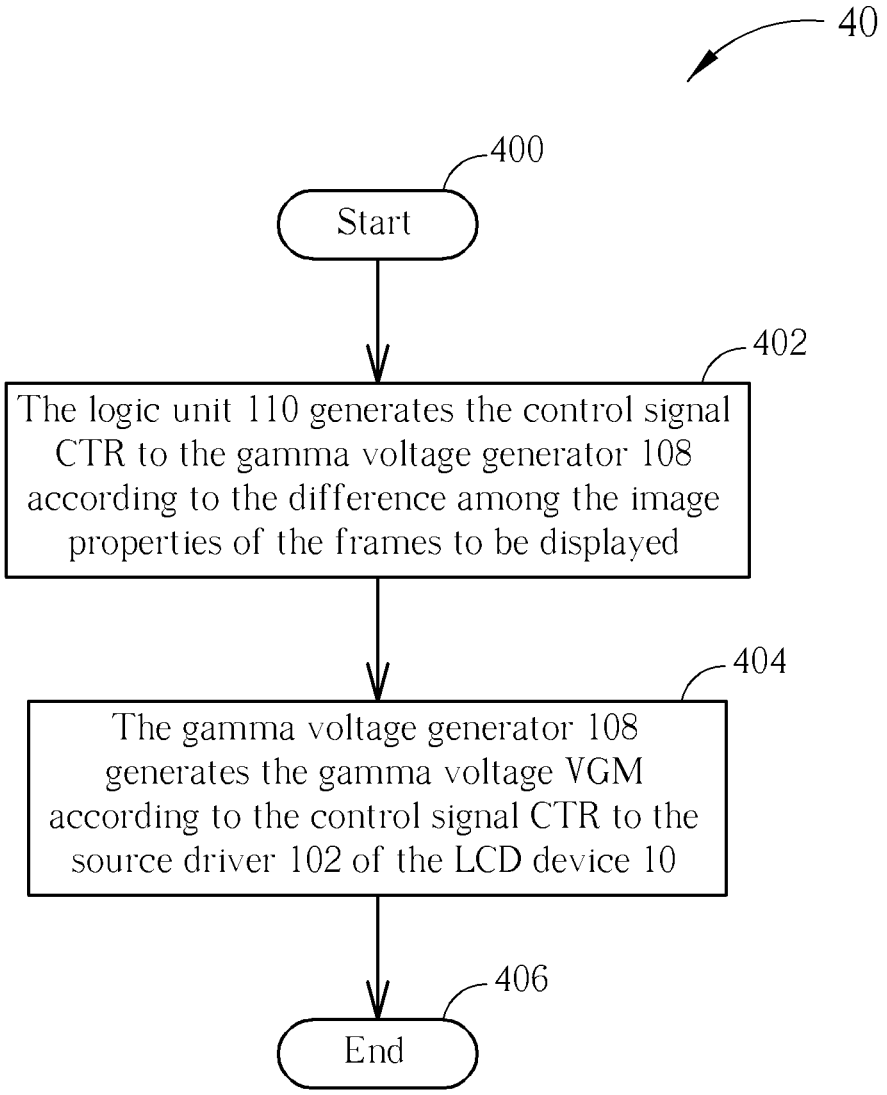
FIG. 4 is a flowchart of a process according to an embodiment of the present invention.

Please refer to FIG. 3, which is a schematic diagram of a voltage divider circuit 300 according to an example of the present invention. The voltage divider circuit 300 is used to realize the gamma voltage generator 108 of FIG. 1, to provide one of a plurality of gamma voltages VGM_b_1-VGM_b_n as the gamma voltage VGM. The gamma voltages VGM_b_1-VGM_b_n can be reduced or retained by the voltage divider circuit 300 according to the control signal CTR. The voltage divider circuit 300 includes a first reference voltage generator 302, a second reference voltage generator 304, a switch 306 and the resistors R1-RN. The first reference voltage generator 302 and the second reference voltage generator 304 generate different reference voltages VRF_1 and VRF_2, respectively. The switch 306 controls the resistors R1-RN to connect to the first reference voltage generator 302 or the second reference voltage generator 304 according to the control signal CTR. For example, VRF__1>VRF__2 is first assumed. When the difference among the contrast ratios of the frames to be displayed is larger than the predefined value, the logic unit 110 determines that the contrast ratios of the frames watched by the user do not need to be changed. Then, the logic unit 110 controls the switch 306 by using the control signal CTR, to connect the resistors R1-RN and the first reference voltage generator 302, so as to retain the gamma voltages VGM_b_1-VGM_b_n. Oppositely, when the difference among the contrast ratios of the frames to be displayed is lower than the predefined value, the logic unit 110 determines that the contrast ratios of the frames watched by the user need to be reduced. Then, the logic unit 110 controls the switch 306 by using the control signal CTR, to connect the resistors R1-RN and the second reference voltage generator 304, so as to reduce the gamma voltages VGM_b_1-VGM_b_n. As a result, the power consumption of the LCD device 10 is reduced.

Figure 2:
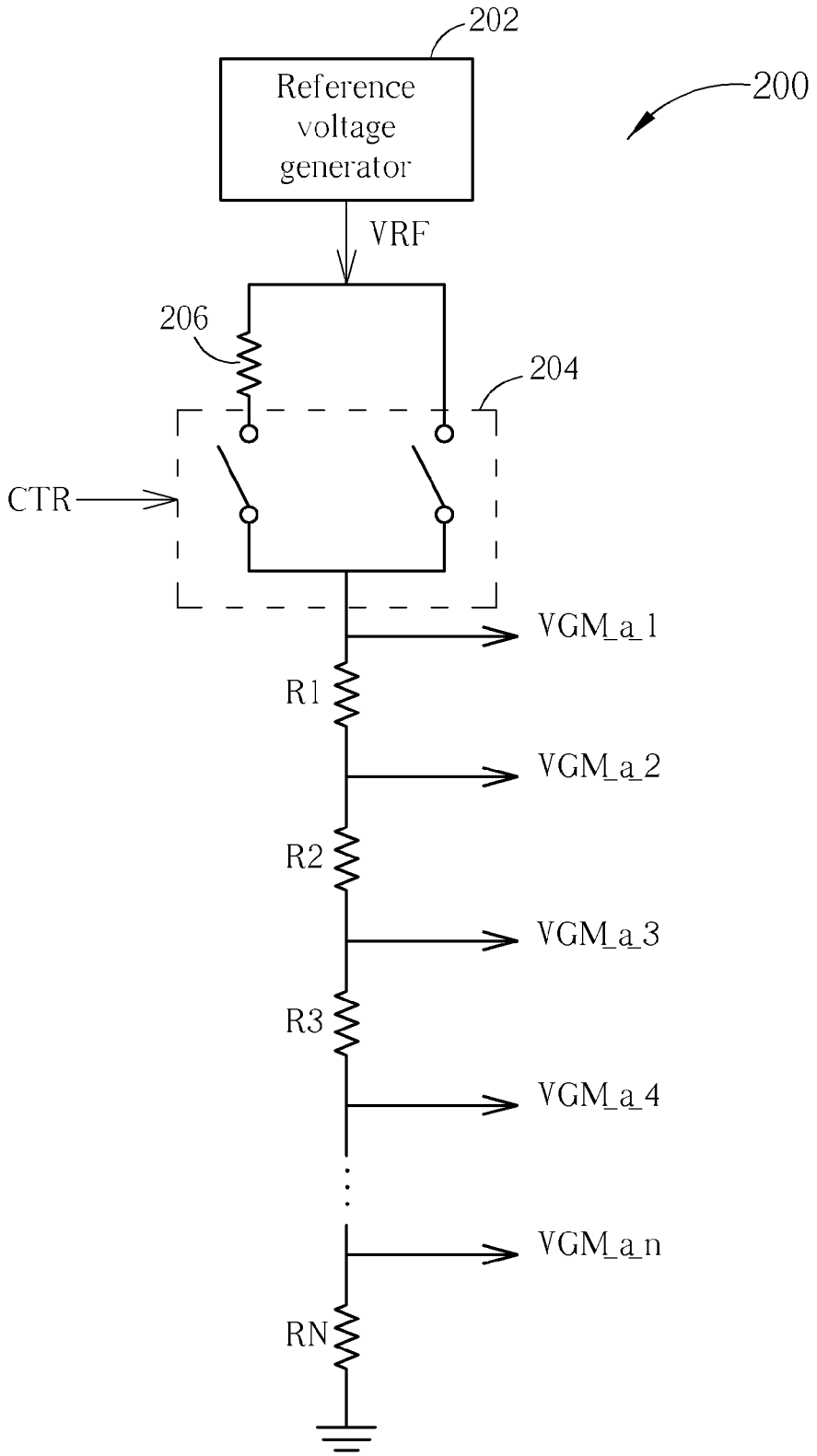
FIG. 2 is a schematic diagram of a voltage divider circuit according to an embodiment of the present invention.

Please note that, the voltage divider circuits 200 and 300 shown in FIGS. 2 and 3, respectively, are simply used to illustrate possible realizations of the gamma voltage generator 108. In practice, any circuit or device capable of adjusting the gamma voltage VGM according to the control signal CTR can be applied to the present invention, but is not limited herein. For example, in addition to adjusting the gamma voltage VGM in two steps, the gamma voltage VGM can also be adjusted in more steps, or be adjusted according to different logic operations. As known by those skilled in the art, if the gamma voltage VGM is adjusted in more steps, corresponding modifications should be made to the gamma voltage generator 108, e.g. increasing a number of reference voltage generators.

The present invention reduces power consumption according the frames to be displayed, and those skilled in the art should readily make modifications or alterations accordingly. For example, the logic 110 can generate the control signal CTR to the gamma voltage generator 108 according to a user control command or a software currently used by the user, to adjust the gamma voltage VGM. In other words, a rule of adjusting the gamma voltage VGM is not limited to consideration of the image properties of the frames to be displayed. A method of adjusting the gamma voltage VGM to reduce the power consumption is also not limited herein. For example, in addition to adjusting the gamma voltage VGM in steps as illustrated above, the power consumption can also be reduced by reducing the maximum gamma voltage and increasing the minimum gamma voltage, or by reducing a difference between the maximum gamma voltage and the minimum gamma voltage. Besides, there are many methods for determining the difference among the image properties of the frames to be displayed, e.g., determining the difference among the image properties by comparing most significant bits (MSBs) of a sub-pixel of a frame to be displayed. If the MSBs of the sub-pixel are the same, a color displayed by the sub-pixel is black or white. Otherwise, if the MSBs are the different, the color displayed by the sub-pixel is colorful. Therefore, if a number of sub-pixels of which MSBs are the same is large, the colors of the frame to be displayed are monotone. In this situation, the user may be doing an activity without needing to watch the frame with a high contrast ratio, e.g., word processing, and the logic unit 110 can adjust the gamma voltage VGM to reduce the power consumption.

Please note that, although the gamma voltage generator 108 and the logic unit 110 are separated from the timing controller 106, the gate driver 104 and the source driver 102 in FIG. 1, the gamma voltage generator 108 and the logic unit 110 can be integrated into the timing controller 106 and/or source driver 102 with improved semiconductor technology. Further, the gamma voltage generator 108, the logic unit 110, the timing controller 106, the source driver 102 and the gate driver 104 can be integrated as a single unit to reduce the cost.

Operations of the gamma voltage generator 108 and the logic unit 110 can be summarized into a process 40 as shown in FIG. 40. The process 40 includes the following steps:

Step 400: Start.

Step 402: The logic unit 110 generates the control signal CTR to the gamma voltage generator 108 according to the difference among the image properties of the frames to be displayed.

Step 404: The gamma voltage generator 108 generates the gamma voltage VGM according to the control signal CTR to the source driver 102 of the LCD device 10.

Step 406: End.

The process 40 is used to illustrate the operations of the gamma voltage generator 108 and the logic unit 110, and detailed operations of the process 40 can be referred to the above illustration, and are not narrated herein.

Please note that, an LCD device is used as an embodiment to explain the present invention. In practice, those skilled in the art can make alternations or modifications such that the driving device and the driving method of the present invention can be realized in various kinds of electronic display devices, such as a plasma display device, a cathode ray tube (CRT) display device, a projector, etc., to reduce the power consumption of the electronic display devices.

In conclusion, the present invention can adjust a gamma voltage according to a difference among image properties of frames to be displayed, to reduce the power consumption of a display device.

Those skilled in the art will readily observe that numerous modifications and alterations of the device and method may be made while retaining the teachings of the invention.

What is claimed is:

1. A driving device of a display device, the driving device comprising:

a gamma voltage generator, for generating a gamma voltage according to a control signal to a source driver of the display device; and a logic unit, for generating the control signal to the gamma voltage generator according to a difference among contrast ratios of a plurality of frames to be displayed, to adjust the gamma voltage, so as to reduce power consumption of the display device.

2. The driving device of claim 1, wherein the gamma voltage generator comprises a plurality of voltage divider circuits for generating a plurality of voltages, and the control signal instructs the gamma voltage generator to output a voltage of the plurality of voltages as the gamma voltage.

3. The driving device of claim 1, wherein the logic unit generates the control signal to the gamma voltage generator to reduce the gamma voltage, when the difference among the contrast ratios of the plurality of frames to be displayed is lower than a predefined value.

4. The driving device of claim 1, wherein the logic unit further generates the control signal to the gamma voltage generator according to a user control command, to adjust the gamma voltage.

5. The driving device of claim 1, wherein the logic unit instructs the gamma voltage generator to adjust the gamma voltage in stages by using the control signal.

6. The driving device of claim 1, wherein the logic unit further detects the contrast ratios of the plurality of frames to be displayed, to determine the difference among the contrast ratios of the plurality of frames to be displayed.

7. The driving device of claim 1, wherein the logic unit is installed in a timing controller of the display device or the source driver.

8. A driving method of a display device, the driving method comprising:

generating a gamma voltage according to a control signal to a source driver of the display device; and generating the control signal according to a difference among contrast ratios of a plurality of frames to be displayed, to adjust the gamma voltage, so as to reduce power consumption of the display device.

9. The driving method of claim 8, wherein generating the gamma voltage according to the control signal to the source driver of the display device comprises generating a plurality of voltages by using a plurality of voltage divider circuits, and selecting a voltage from the plurality of voltages as the gamma voltage according to the control signal.

10. The driving method of claim 8, wherein generating the control signal according to the difference among the contrast ratios of the plurality of frames to be displayed, to adjust the gamma voltage comprises generating the control signal to reduce the gamma voltage, when the difference among the contrast ratios of the plurality of frames to be displayed is lower than a predefined value.

11. The driving method of claim 8 further comprising generating the control signal according to a user control command, to adjust the gamma voltage.

12. The driving method of claim 8, wherein generating the control signal according to the difference among the contrast ratios of the plurality of frames to be displayed, to adjust the gamma voltage comprises adjusting the gamma voltage in stages by using the control signal.

13. The driving method of claim 8, wherein generating the control signal according to the difference among the contrast ratio of the plurality of frames to be displayed, to adjust the gamma voltage further comprises detecting the contrast ratio of the plurality of frames to be displayed, to determine the difference among the contrast ratio of the plurality of frames to be displayed.

* * * * *